US006250769B1

(12) United States Patent
Kirk

(10) Patent No.: US 6,250,769 B1
(45) Date of Patent: Jun. 26, 2001

(54) VISOR LIGHT CAP

(76) Inventor: Clair F. Kirk, 856 Pine, Wheatland, WY (US) 82201

( * ) Notice: Subject to any disclaimer, the term of this patent is extended or adjusted under 35 U.S.C. 154(b) by 0 days.

(21) Appl. No.: 09/394,814

(22) Filed: Sep. 13, 1999

(51) Int. Cl.[7] ..... F21V 21/84
(52) U.S. Cl. ..... 362/106
(58) Field of Search ..... 362/106

(56) References Cited

U.S. PATENT DOCUMENTS 3,133,705 * 5/1964 Eickelman ..... 362/106
4,406,040 * 9/1983 Cannone ..... 24/3.12
4,827,384 * 5/1989 Von Schlemmer ..... 362/106
4,991,068 * 2/1991 Mickey ..... 362/106
5,463,538 * 10/1995 Womack ..... 362/106
5,541,816 * 7/1996 Miserendino ..... 362/106
5,567,038 * 10/1996 Lary ..... 362/106
6,056,413 * 5/2000 Urso ..... 362/106

* cited by examiner

*Primary Examiner*—Sandra O'Shea
*Assistant Examiner*—Hargobind S. Sawhney

(57) ABSTRACT

Headgear such as a cap for use in dark and very confined spaces having a light attached to its visor in a manner that the light beam is parallel to the central axis of the visor and to the plane of vision of the wearer.

1 Claim, 1 Drawing Sheet

VISOR LIGHT CAP

BACKGROUND

This invention relates to caps and other types of headgear which are worn in dark places.

SUMMARY

This invention relates to caps and similar head covers ("headgear") which are worn by persons who work in or are otherwise engaged in activities in dark places.

BRIEF DESCRIPTION OF THE DRAWING

The drawing is a schematic view in side elevation of a preferred embodiment of the present invention.

DETAILED DESCRIPTION OF PREFERRED EMBODIMENTS

Figure 1:
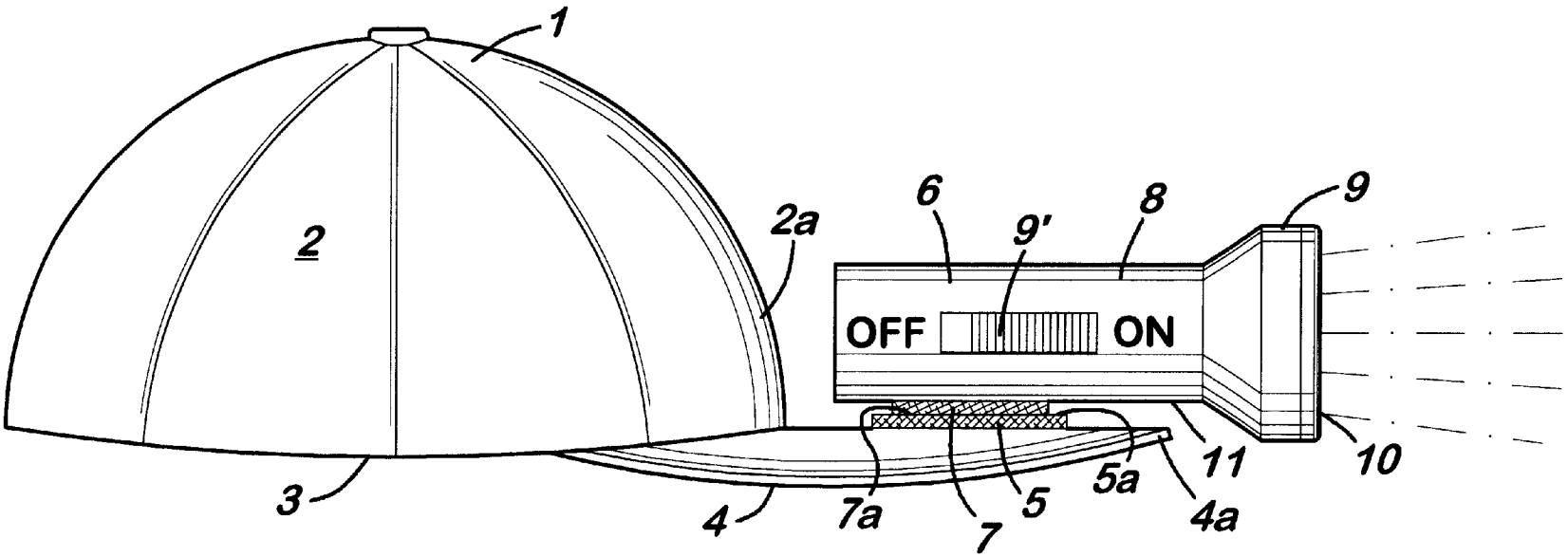

Many persons work in the dark, including telephone installers and repair persons who often must go into underground tunnels and repair or install the lines. These tunnels are not lighted and, therefore, a source of light is needed.

If the underground place is large enough, it is often possible to use standard work lights powered by batteries or via AC cord (when an AC outlet is near). These standard lights are placed on the ground or hung from overhead.

However, there are many situations where the tunnel is narrow and very long, such as hundreds of years long, and where no AC source is available. Further, there is no room in such places for placement of the large, standard lights described and such standard lights cannot be conveniently carried because of lack of space and also because the worker must use both hands to perform various tasks, such as repairing or installing telecommunication cables or similar lines. This can be called the "narrow tunnel" situation for these purposes.

In the "narrow tunnel" case, therefore, the worker must have a source of light. Because his or her hands are both needed, the light must be on the worker.

Miner's helmets, of course, are well known as one approach to this problem. However, such helmets are not, it is believed, mounted on a plane parallel with the helmet visor and thus do not shine precisely where the miner is working, but just illuminate the general area.

However, in the case of telecommunications workers described, the tasks they must perform in the "narrow tunnel" confined spaces require very intense light focused where they are looking, since they are attempting to deal with very small wires, screws, fasteners. In such "narrow tunnel" circumstances, it is vital that the worker have a light which focuses its beam parallel to the eyes of the worker.

I have discovered that this technical problem can be solved by means of the present invention.

Thus, the drawing shows a cap generally designated 1, which may be cloth or of rigid material. Cap 1 has a main head cover portion 2 and a visor 4 which extends from the lower periphery 3 of cap 1.

Visor 4 is preferably flat and extends from the front 2*a* of the body portion 2 to an forward edge 4*a*.

Affixed to the top of visor 4 is a fastener 5, which is preferably Velcro and has an upper surface 5*a* for detachably connecting to another fastener.

The source of light is shown generally as 6 and may be any suitable light source, such as a battery flashlight. Light 6 has a essentially flat lower surface 11. A fastener 7 has an upper surface attached to surface 11 of light 6.

Fastener 7 is of material which can detachably connect with surface 5*a* and may be Velcro . Fastener 7 has a lower surface 7*a* for detachably connecting to fastener surface 5*a*.

The fasteners 5 and 7 are preferably flat topped and serve to align the light 6 in a plane parallel to the preferably flat plane of visor 4 which results in the desired configuration, namely, that the light beam is co-planar with the eyes of the person wearing the cap, so as to ensure that the light beam focuses where the eyes are looking at all times.

Of course, the visor may not be flat and the fasteners may also have other than flat top and bottom surfaces. However, while such arrangements can be made, it is within the scope of this invention to provide a structure wherein the light beam is parallel to the eyes by making necessary modifications to the Velcro (or other fasteners).

Light 6 includes an enlarged lens cover 9 attached to body 8 of the light and the lens itself is 10. A slide switch 9 is used to turn the light 6 on and off.

From the foregoing, it will be understood that this invention provides an inexpensive system employing, if desired, an ordinary cap with a flat visor and uses interlocking fasteners, such as Velcro strips, to mount a flashlight so that the light beam is parallel to the visor surface.

What is claimed is:

1. A visor light cap combination for a person working in dark places including:

a) a cap for the person's head;

b) a visor connected to said cap, said visor having an upper and lower surface, opposing side edges, a rear edge adjacent the head portion of the cap and a front portion;

c) said visor upper surface having a central longitudinal visor axis extending linearly from the rear visor edge to the front edge of the visor;

d) said visor upper surface having an essentially flat portion along said central visor axis, which flat portion comprises a flat light supporting means;

e) first fastener means attached to said flat light supporting means;

f) a light having an outer case, said case having a longitudinal axis; said case having an interior compartment for at least one battery; said case being devoid of any externally extending arms or other elements;

g) a light source connected to one end of said case, said light source having a linear light beam coaxial with the longitudinal axis of the outer case;

h) said case having second fastener means for direct attachment with said first fastener means so that said first and second fastener means are attached to each other to thereby securely attach the case to the upper flat visor surface along said flat longitudinal axis of the visor;

i) whereby said linear light beam is held in a position co-axial with the longitudinal central axis of the visor and projects said linear beam of light along said longitudinal central axis whereby, by movement of the head of the person wearing the visor cap, the linear beam of light is sharply focused on such location as the wearer desires.

* * * * *